United States Patent [19]

Rademacher

[11] 4,379,704

[45] Apr. 12, 1983

[54] LEG BUOY FOR TRAINING SWIMMERS

[75] Inventor: Thomas P. Rademacher, Medina, Ohio

[73] Assignee: NcNeil Corporation, Akron, Ohio

[21] Appl. No.: 258,603

[22] Filed: Apr. 29, 1981

[51] Int. Cl.[3] ..... B63C 9/08

[52] U.S. Cl. ..... 441/88

[58] Field of Search ..... 9/8 R, 14, 301, 307, 9/310 J, 310 R, 311-312, 315, 329, 336, 337, 338, 339, 340, 348, 400; 441/1, 55, 60, 80, 88; 272/1 B; 434/254

[56] References Cited

U.S. PATENT DOCUMENTS 174,217 2/1876 English ..... 9/336

2,935,751 5/1960 Emmick et al. ..... 9/339

*Primary Examiner*—Trygve M. Blix

*Assistant Examiner*—Jesus D. Sotelo

*Attorney, Agent, or Firm*—Hamilton, Renner & Kenner

[57] ABSTRACT

A buoy for supplementing the buoyancy of a swimmer's legs comprising, a unitary foam member (11) having a flexible generally water impervious skin (41) adapted for engagement with and selective retention by the legs of a swimmer, the foam member having spaced cylindrical elements (12,13), being of generally prolate circular cross section (14,15), the circular cross section (15) of one of the cylindrical elements being substantially smaller than the circular cross section (14) of the other of the cylindrical elements and a shank (25) spacing and joining the cylindrical elements and being substantially narrower than the circular cross section of either of said cylindrical elements (12,13).

10 Claims, 4 Drawing Figures

LEG BUOY FOR TRAINING SWIMMERS

TECHNICAL FIELD

The present invention relates generally to a flotation device for use by swimmers. More particularly, the present invention relates to a device for providing flotation for a swimmer's legs in the development of swimming techniques. More specifically, the present invention relates to a leg buoy for floating a swimmer's legs and lower torso as during the development of arm stroking techniques and strength and endurance.

BACKGROUND ART

With the increasing popularity of competitive swimming and the attendant emphasis upon sophisticated training procedures and training equipment, there has been a vast increase in the appearance of different devices for use in competitive and recreational swimming development. One area which has seen a proliferation of activity is in regard to flotation devices which are employed to effect or supplement flotation and provide total or partial immobilization of a portion or portions of a swimmer's body in order to concentrate on the development of techniques involving other body portions involved in a total stroke makeup. Examples of devices of this nature are leg buoys and kickboards which have been developed in a variety of forms.

In regard particularly to leg buoys, such devices are employed to provide flotation for and essential immobilization of a swimmer's legs, while permitting the development of improved techniques or strength and endurance with respect to arm motions and/or breathing techniques. Leg buoys of various types have been developed primarily from inflated or foam materials which within limited size constraints produce significant buoyant assist to the legs of a swimmer. In some instances dual flotation elements have been joined by rope or other connectors such that a flotation element is positioned above and below the legs of a swimmer horizontally positioned in a back or front prone position in a pool. In other instances, composite flotation elements have been provided which effect some extent of conformance with body contours to assist in the selective retention of the leg buoy with minimal leg effort on the part of the swimmer. While the flotation objective has been generally achieved by most of these devices the adaptability of these devices to swimmers of different sizes and weights has in many instances been inadequate. In addition, some of these devices have not been constructed in such a fashion as to withstand the rigors of both proper and occasionally improper usage which inevitably results in the recreational environment of most swimming pools.

DISCLOSURE OF THE INVENTION

Therefore, an object of the present invention is to provide a leg buoy which is effective in supplementing the buoyancy of a swimmer's legs for exercise or drills directed to improving breathing techniques or arm stroking techniques, strength and endurance. Another object of the present invention is to provide a leg buoy which has a universal configuration for easy retention by the legs of a swimmer irrespective of the particular size and shape of the swimmer's legs. A further object of the invention is to provide a single size leg buoy which can be successfully employed by swimmers of substantially different sizes and weights, i.e., from children to adults, and which depending upon its orientation and positioning can produce variable buoyancy effects on an individual swimmer.

Yet another object of the invention is to provide a leg buoy which is configured such that it does not have rough or abrasive surfaces which could injure or irritate a swimmer's skin. A still further object of the invention is to provide a leg buoy which is resistant to environmental conditions, rough usage or even an extent of abuse and can be subjected to all the rigors of a pool environment with little probability of sustaining permanent damage. Still another object of the invention is to provide a leg buoy which is relatively inexpensive to acquire, easy to learn to utilize and otherwise well adaptable for its intended purpose.

In general, a leg buoy for supplementing the buoyancy of a swimmer's legs includes, a unitary foam member adapted for engagement with and selective retention by the legs of a swimmer, the foam member having spaced cylindrical elements, the cylindrical elements being of generally prolate circular cross section with the circular cross section of one of the cylindrical elements being substantially smaller than the circular cross section of the other of the cylindrical elements, a shank spacing and joining the cylindrical elements, the shank being substantially narrower than the circular cross section of either of the cylindrical elements, and a flexible generally water impervious skin encompassing the entirety of the unitary foam member.

PREFERRED EMBODIMENT FOR CARRYING OUT THE INVENTION

Figure 1:
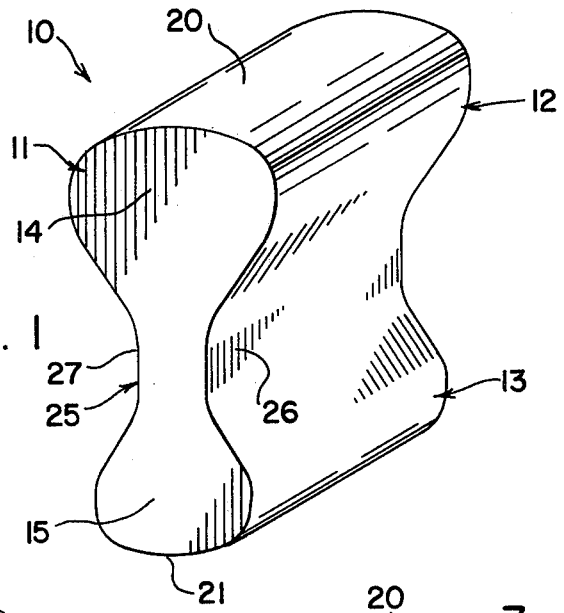
FIG. 1 is a perspective view of a leg buoy embodying the concepts of the present invention.

A leg buoy according to the concepts of the present invention is generally indicated by the numeral 10 in FIG. 1 of the drawings. As shown, the leg buoy 10 is preferably a unitary body 11 which may preferably be a relatively flexible polyethylene foam construction of any of various types which would be apparent to persons skilled in the foam processing art.

The unitary foam body 11 preferably consists of two spaced elements, generally indicated by the numerals 12 and 13, which are of a generally cylindrical configuration preferably being substantially solid and having a substantially curvilinear cross section and oriented in substantially parallel relationship. The cylindrical elements 12 and 13 have generally prolate circular cross-sectional areas 14 and 15, disposed at the extremities of the body as depicted in FIG. 1 and in the sectional view of FIG. 2. The prolate circular cross sections 14, 15 each have laterally opposed generally circular surfaces 16 with respect to prolate circular cross section 14 and like circular surfaces 17 with respect to prolate circular cross section 15. As seen, the radius of the circular surfaces 16 of prolate circular cross section 14 is preferably substantially larger than the radius of the circular surfaces 17 of the prolate circular cross section 15. It has been emperically determined that these radii may advantageously be varied such that the cross-sectional area of the prolate circular cross section 14 is approximately twice as large as the prolate circular cross section 15. It is thus to be appreciated that substantially greater buoyancy is provided by submerging the cylindrical element 12 in water than in submerging the cylindrical member 13, as explained hereinafter.

Figure 3:
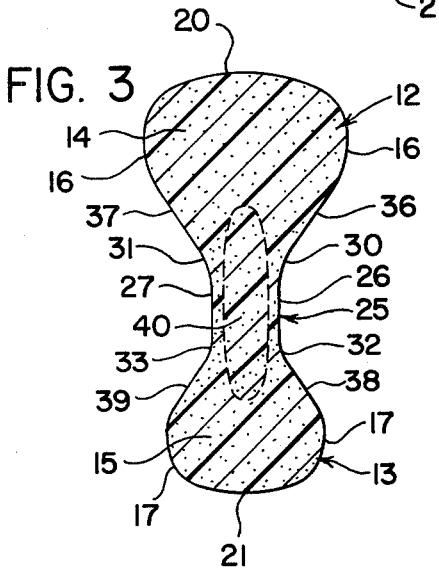
FIG. 3 is a sectional view of the leg buoy of FIGS. 1 and 2 taken substantially along the line 3—3 of FIG. 2.

The prolate circular cross sections 14 and 15 are bounded at the extremities of the unitary body 11 by circular prolate surfaces 20 and 21, respectively. The surfaces 20 and 21 are significant in constituting the prolate circular cross sections 14, 15 due to the fact that the radius of surfaces 20, 21 is greater than the radii of either of the circular surfaces 16 or 17. As shown, the radii of the circular prolate surfaces 20 and 21 may be substantially equal and numerically constitute a value of one-half the overall height of the unitary body 11 as viewed in FIGS. 2 and 3.

Figure 2:
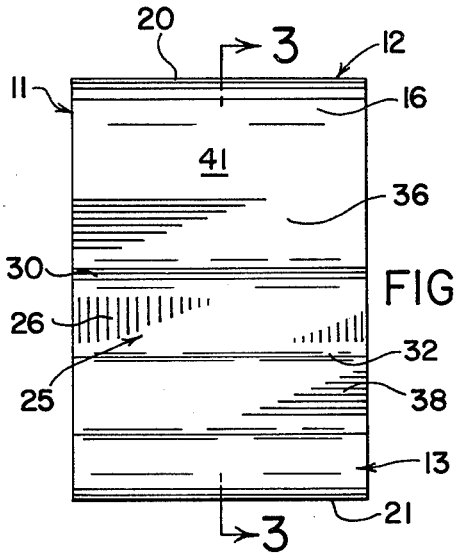
FIG. 2 is a side elevation of the leg buoy of FIG. 1.
Figure 4:
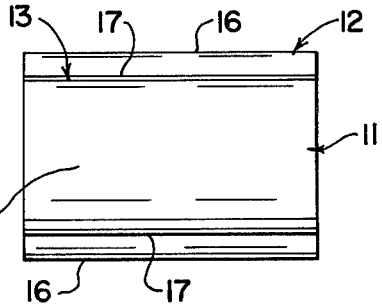
FIG. 4 is a bottom plan view of the leg buoy of FIG. 1.

The cylindrical elements 12, 13 are spaced and joined by a shank portion, generally indicated by the numeral 25. As best seen in FIGS. 1 and 2, the intermediate portion of the shank 25 has a width which is substantially less than the diameter of either of the prolate circular cross sections 14, 15. For reasons specified hereinafter this width is preferably less than one-half the diameter of the smaller prolate circular cross section 15. The minimum width portion of shank 25 is preferably defined by substantially linear surfaces 26 and 27 which may be parallel to form an area having a substantially rectangular cross section. The linear surfaces 26 and 27 have curvilinear transition surfaces 30 and 31 at the upper extremities respectively and similar curvilinear transition surfaces 32 and 33 at the lower extremities, respectively. The transition surfaces 30 and 31 merge with connecting surfaces 36 and 37 respectively, which interconnect with the circular surfaces 16 of the prolate circular cross section 14. Similarly, transition surfaces 32 and 33 merge with connecting surfaces 38 and 39, respectively, which interconnect with the circular surfaces 17 of the prolate circular cross section 15. Thus, the portion of the leg buoy 10 intermediate the cylindrical elements 12 and 13 is composed of on one side a substantially linear element 26 with linear connecting surfaces 36 and 38 angling outwardly therefrom. The linear connecting surfaces 37 and 39 similarly angle outwardly from the linear surface 27. This configuration is adapted to interfit with the interior surface of the legs of the swimmer. The length of the surfaces constituting the shank 25 may readily be designed to engage legs of different sizes thereby accommodating both adult and children swimmers.

In order to obviate the possibility of damage due to mistreatment of the buoy 10 and to prevent undue compression in the shank area 25, this portion of the buoy 10 may be designed to have greater strength and rigidity. This may be accomplished as by employing a denser foam disposition in the shank area 25. In particular, an exemplary reinforced area 40 is depicted in dotted lines in FIG. 2 which extends intermediate the linear surfaces 26 and 27 of shank 25 and between the transition surfaces 30, 31 and 32, 33 and into the area between connecting surfaces 36 and 37 and 38 and 39. A buoy having a reinforced area 40 is thus provided with increased resistance to damage by crushing or bending forces which might be applied to the shank area 25.

The unitary body 11 of the leg buoy 10 preferably has a skin 41 which encompasses the entire outer surface thereof. The skin 41 may be formed in whole or in part integrally with the foam or may be achieved by the controlled application of heat after formation over all or certain portions of the surface according to techniques well known to persons skilled in the art. The provision of outer skin 41 provides a smooth, non-irritating surface for engaging a swimmer's epidermis while providing an external seal on the foam body 11 which results in a more water impervious surface and thus a more buoyant body irrespective of the duration of water exposure.

In use the leg buoy 10 is employed by swimmers by positioning the legs to either side of shank portion 25. More particularly, the inner surfaces of the legs are brought into engagement with the linear surfaces 26 and 27. With the shank width substantially smaller and preferably less than one-half the diameter of the smaller prolate circular cross section 15, the buoy 10 cannot be displaced upwardly or downwardly relative to the legs so long as the swimmer's legs are maintained in relatively close parallel proximity.

It is also to be noted that the inner surfaces of a swimmer's legs engage linear surfaces 26 and 27 as well as linear connecting surfaces 36,37 and 38,39. The engagement and intermittent gripping of these surfaces by curved leg contours tends to form randomly located air pockets of reduced pressure which promote additional adherence between the skin 41 of the buoy 10 and a swimmer's legs, as contrasted with the total air displacement which tends to take place in the event that the shank 25 is circularly or otherwise curvilinearly contoured to approximate the leg contour of a swimmer. Such a circular or otherwise curvilinear contour also has the disadvantage that it is difficult to construct a curved configuration which is fully adaptable to legs of different sizes.

As indicated above, the orientation of the leg buoy 10 can be used to achieve a desired extent of buoyancy. In this respect it will be appreciated that submerging the larger prolate circular cross section 14 downwardly such that a greater area of the leg buoy 10 remains submerged provides a substantially greater buoyant effect than inverting the leg buoy 10 such that prolate circular cross section 15 is downwardly positioned. It has been emperically determined that a relative cross-sectional area ratio of approximately 2:1 as between the prolate circular cross sections 14 and 15 provides an appropriate buoyancy differential to produce satisfactory results for both lightweight children and relatively heavy adults. The dimensions of a particular leg buoy in regard to the size of the prolate circular cross sections 14, 15 may be varied depending upon the buoyancy characteristics of the particular foam selected. In addition, the length of the leg buoy 10 may be varied to alter buoyancy characteristics. It has been emperically determined that a buoy having an overall height of approximately 10 inches and a length of approximately 5 to 8 inches provides suitable buoyancy characteristics with foams which might characteristically be employed for this purpose. It should also be appreciated that the buoyant effect upon a swimmer's body may be varied to produce desired results by altering the position of the buoy longitudinally of a swimmer's legs.

Thus it should be evident that the leg buoy disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. A buoy for supplementing the buoyancy of a swimmer's legs comprising, a unitary foam member adapted for engagement with and selective retention by the legs of a swimmer, said member having spaced cylindrical elements, said cylindrical elements being of generally prolate circular cross section, the circular cross section of one of said cylindrical elements being substantially smaller than the circular cross section of the other of said cylindrical elements in that engaging the buoy with the cylindrical element of smaller cross-section submerged provides lesser buoyant effect than with the other cylindrical element submerged, shank means spacing and joining said cylindrical elements, said shank means being substantially narrower than the circular cross section of either of said cylindrical elements, and a flexible generally water impervious skin encompassing the entirety of said unitary member.

2. A buoy according to claim 1, wherein said cylindrical elements have prolate circular surfaces of the same radius.

3. A buoy according to claim 2, wherein said circular prolate surfaces are formed about a point in said shank means substantially medially of the height of said unitary member.

4. A buoy according to claim 1, wherein the radius of the larger of said cylindrical elements is larger than the radius of the other of said tubular elements.

5. A buoy according to claim 4, wherein the circular cross section of the larger of said cylindrical elements has an area approximately twice the area of the circular cross section of the other of said cylindrical elements.

6. A buoy according to claim 1, wherein the width of said shank means is less than one-half the diameter of the cylindrical element having the smaller circular cross section.

7. A buoy according to claim 1, wherein a portion of said shank means located substantially intermediate said cylindrical elements has substantially linear surfaces defining a portion having a substantially rectangular cross section.

8. A buoy according to claim 7, wherein said cylindrical elements have substantially linear surfaces joining said shank means.

9. A buoy according to claim 8, wherein curvilinear transition surfaces join said linear surfaces of said cylindrical elements and the linear surfaces defining the portion having a substantially rectangular cross section.

10. A buoy according to claim 1, wherein said shank means is composed of a denser foam than said cylindrical elements for increased strength and rigidity.

* * * * *